US007150417B2

(12) United States Patent
Souma

(10) Patent No.: US 7,150,417 B2
(45) Date of Patent: Dec. 19, 2006

(54) FUEL INJECTION VALVE

(75) Inventor: Masahiro Souma, Ibaraki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/362,352

(22) Filed: Feb. 27, 2006

(65) Prior Publication Data

US 2006/0196978 A1 Sep. 7, 2006

(30) Foreign Application Priority Data

Mar. 1, 2005 (JP) ..... 2005-056588

(51) Int. Cl.
*B05B 1/30* (2006.01)

(52) U.S. Cl. ..... 239/585.1; 239/585.3; 239/585.4; 239/585.5; 239/900; 251/129.15

(58) Field of Classification Search ..... 239/596, 239/601, 900, 585.1–585.5, 532.2–533.12; 251/129.15
See application file for complete search history.

(56) References Cited

U.S. PATENT DOCUMENTS 5,437,413 A * 8/1995 Shen et al. ..... 239/424.5
5,746,376 A * 5/1998 Romann et al. ..... 239/585.4
5,862,991 A * 1/1999 Willke et al. ..... 239/397.5
6,877,678 B1 * 4/2005 Xu et al. ..... 239/533.12

FOREIGN PATENT DOCUMENTS

JP 10-122085 A 5/1998

* cited by examiner

*Primary Examiner*—Dinh Q. Nguyen
(74) *Attorney, Agent, or Firm*—Sughrue Mion, PLLC

(57) ABSTRACT

A valve seat member has a valve seat with a fuel injection aperture. A valve body is movable between a close position wherein the valve body is put on the valve seat and an open position wherein the valve body is separated from the valve seat. A biasing member biases the valve body in a direction of the close position. An electromagnetic coil, upon energization, moves the valve body in a direction of the open position against the biasing force of the biasing member. A nozzle plate is connected to the valve seat member in a manner to cover the fuel injection aperture. The nozzle plate has at a part thereof facing the fuel injection aperture a domed portion that is projected away from the fuel injection aperture. The domed portion has a plurality of fuel injection openings. A side wall extends around and along a periphery of the nozzle plate so as to form a fuel holding recess that is defined by the nozzle plate other than domed portion and the side wall. The fuel holding recess is able to hold a certain amount of a fuel by the force of a surface tension possessed by the fuel.

7 Claims, 3 Drawing Sheets

FUEL INJECTION VALVE

BACKGROND OF THE INVENTION

1. Field of the Invention

The present invention relates to fuel injection valves for internal combustion engines.

2. Description of the Related Art

Hitherto, various fuel injection valves for internal combustion engines have been proposed and put into practical use. One of them is shown in Japanese Laid-open Patent Application (Tokkaihei) 10-122085, which generally comprises a seat member with a fuel injection opening, a valve proper movable in a direction to selectively close and open the fuel injection opening, a biasing means for biasing the valve proper in a direction to close the aperture and an electromagnetic coil that, when energized or in ON condition, lifts the valve proper from the seat member to open the opening. Thus, in response to ON/OFF condition of the electromagnetic coil, a fuel injection through the fuel injection opening is effected and stopped continuously.

SUMMARY OF THE INVENTION

However, due to inherent construction, some of the fuel injection valves of the above-mentioned type have the following drawbacks. That is, long usage of the fuel injection valve tends to produce a fuel composition deposit at a peripheral area of the fuel injection opening. Such deposit has an undesired effect on the fuel injection performance, particularly on the fuel injection rate and fuel mist shaping.

It is therefore an object of the present invention to provide a fuel injection valve which is free of the above-mentioned drawback.

In accordance with a first aspect of the present invention, there is provided a fuel injection valve which comprises a valve seat member having a valve seat with a fuel injection aperture; a valve body that is movable between a close position wherein the valve body is put on the valve seat and an open position wherein the valve body is separated from the valve seat; a biasing member that biases the valve body in a direction of the close position; an electromagnetic coil that, upon energization, moves the valve body in a direction of the open position against the biasing force of the biasing member; a nozzle plate connected to the valve seat member in a manner to cover the fuel injection aperture, the nozzle plate having at a part thereof facing the fuel injection aperture a domed portion that is projected away from the fuel injection aperture, the domed portion having a plurality of fuel injection openings; and a side wall that extends around and along a periphery of the nozzle plate so as to form a fuel holding recess that is defined by the nozzle plate other than domed portion and the side wall, the fuel holding recess being able to hold a certain amount of a fuel by the force of a surface tension possessed by the fuel.

In accordance with a second aspect of the present invention, there is provided a fuel injection valve which comprises a cylindrical valve seat member having a valve seat with a fuel injection aperture; a valve body having a valve ball, the valve ball being movable between a close position wherein the valve ball is put on the valve seat and an open position wherein the valve ball is separated from the valve seat; a biasing member that biases the valve ball of the valve body in a direction of the close position; an electromagnetic coil that, upon energization, moves the valve ball of the valve body in a direction of the open position against the biasing force of the biasing member; a circular nozzle plate connected to the cylindrical valve seat member in a manner to cover the fuel injection aperture, the circular nozzle plate having at a center part thereof facing the fuel injection aperture a domed portion that is projected away from the fuel injection aperture, the domed portion having a plurality of fuel injection openings; and a cylindrical side wall that extends around and along a periphery of the circular nozzle plate so as to form a fuel holding recess that is defined by the circular nozzle plate other than domed portion and the cylindrical side wall, the fuel holding recess being able to hold a certain amount of a fuel by the force of a surface tension possessed by the fuel.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
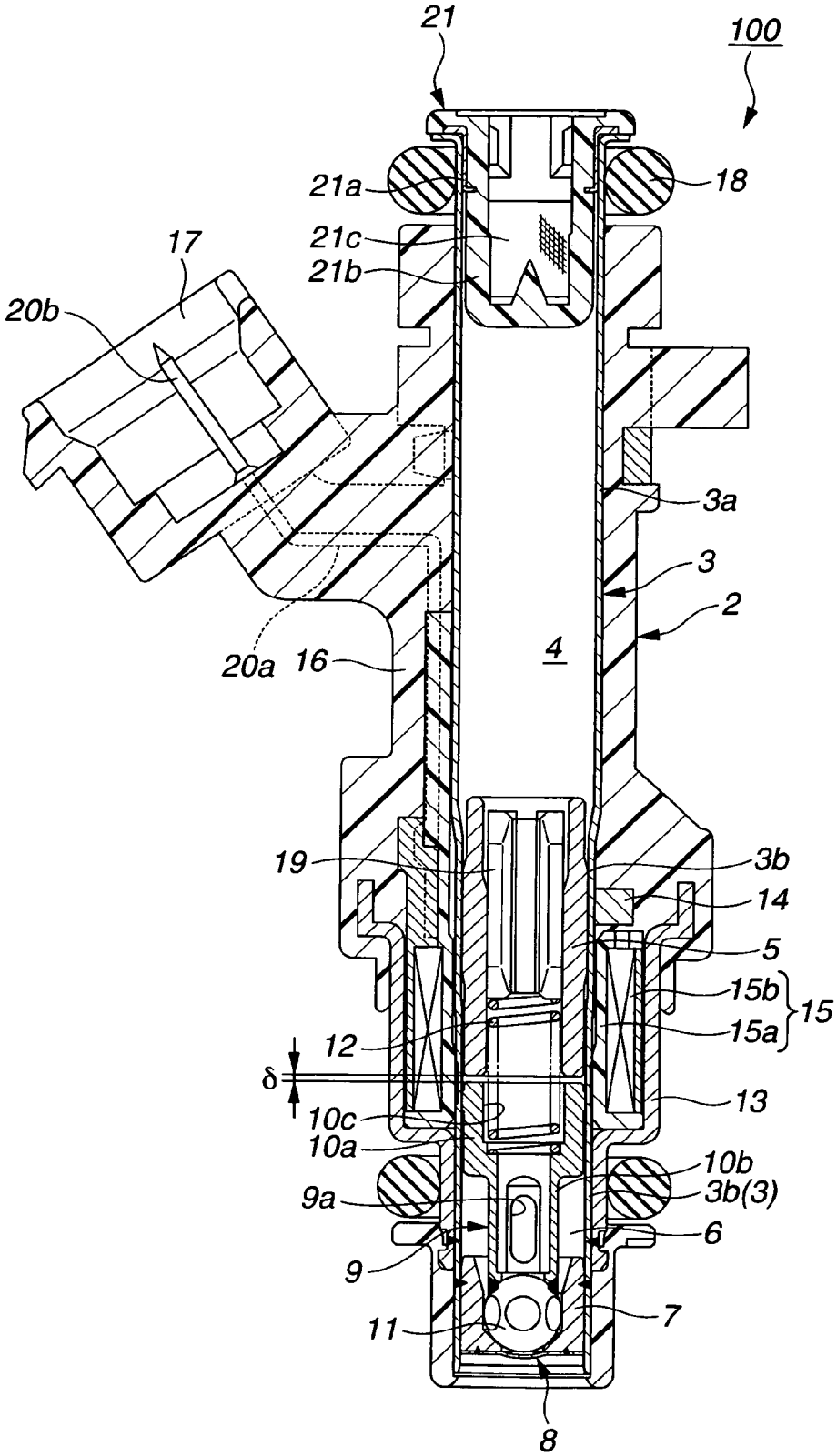
FIG. 1 is a sectional view of a fuel injection valve of the present invention.

In the following, a fuel injection valve 100 of the present invention will be described in detail with reference to the accompanying drawings.

For ease of understanding, various directional terms such as right, left, upper, lower, rightward and the like will be used in the following description. However, such terms are to be understood with respect to only the drawing or drawings on which a corresponding portion or part is shown.

Referring to FIG. 1, there is shown in a sectional manner an entire construction of the fuel injection valve 100 of the present invention.

As shown, fuel injection valve 100 generally comprises a magnetic metal tube 3, a plastic casing 2 covering magnetic metal tube 3, a metal core tube 5 received in a lower portion of metal tube 3, a metal yoke member 13 arranged to surround core tube 5 through metal tube 3, and a plastic cover 16 embedded in plastic casing 2.

Magnetic metal tube 3 is produced by pressing a magnetic stainless steel. As is shown, magnetic metal tube 3 comprises a larger diameter upper portion 3*a* and a smaller diameter lower portion 3*b* which are connected through a tapered center portion (no numeral). Although not shown in the drawing, in practical use, an upper end of magnetic metal tube 3 is received in a boss part of a fuel piping so that a fuel is fed to an interior 4 of metal tube 3.

Disposed about an upper end of metal tube 3 is an O-ring 18 by which a hermetical sealing between the upper end of metal tube 3 and the boss part of the fuel piping is achieved.

Disposed in the upper end of metal tube 3 is an injection molded filter unit 21 that comprises an annular metal core 21*a*, a cylindrical plastic frame 21*b* held by metal core 21*a* and a mesh member 21*c* held by frame 21*b*. Preferably, plastic frame 21*b* is made of soft plastic material, such as fluorine plastic, Nylon (Trade name) or the like which is softer than magnetic metal tube 3. Due to provision of mesh member 21*c*, the fuel is filtered before flowing into the interior 4 of metal tube 3 from the fuel piping. As shown, metal core tube 5 is concentrically received in smaller diameter lower portion 3*b* of metal tube 3. As will become apparent as the description proceeds, metal core tube 5 functions to form a closed loop magnetic path for an electromagnetic coil 15 in cooperation with an anchor portion 10*a* of a valve body 9 and yoke member 13. Furthermore, metal core tube 5 has another function to control or adjust an open position of valve body 9. In the illustrated embodiment, metal core tube 5 is press-fitted in metal tube 3 leaving a predetermined small clearance "67" between an upper end of anchor portion 10*a* of valve body 9 and a lower end of metal core tube 5.

Figure 2:
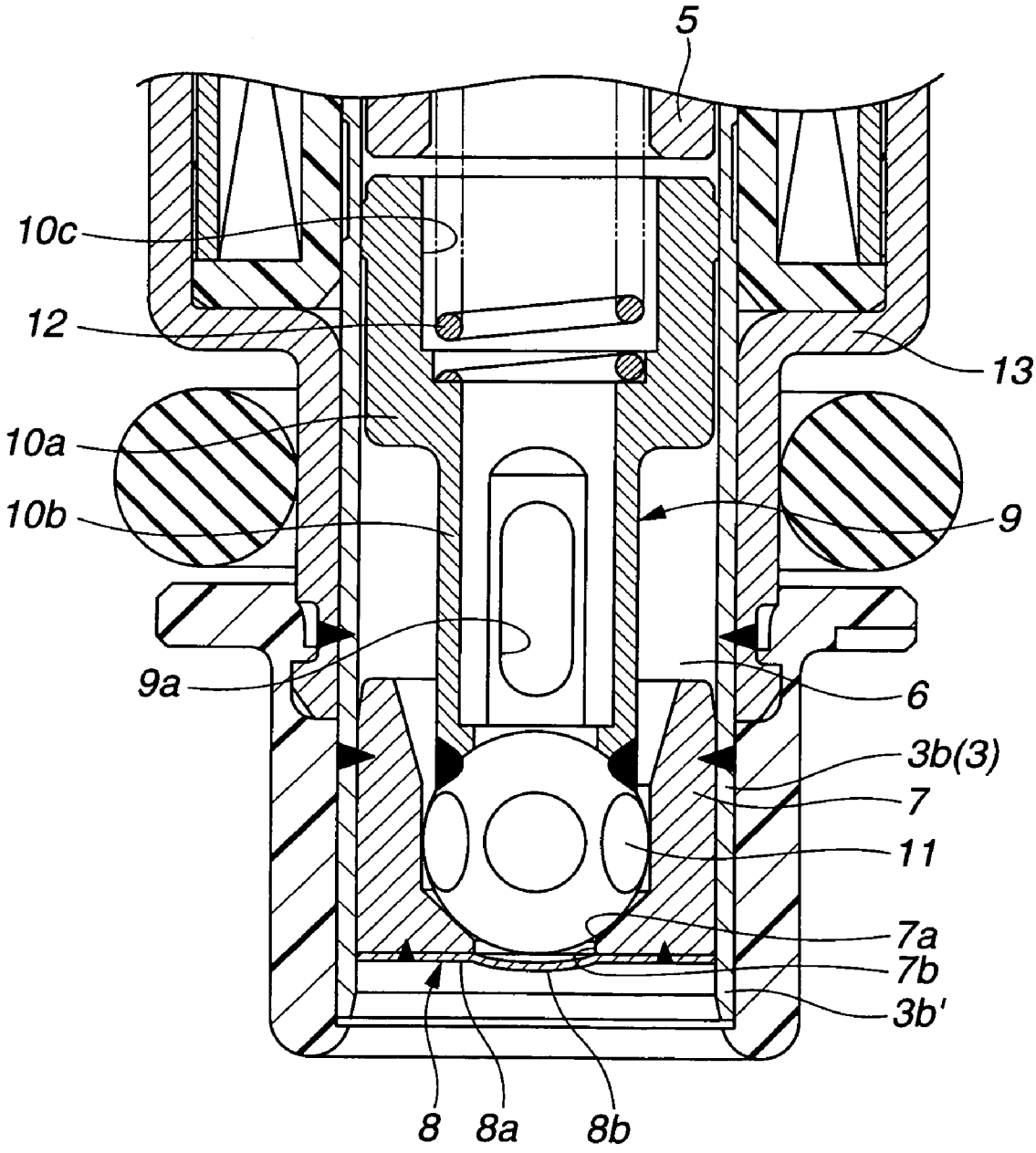
FIG. 2 is an enlarged sectional view of an essential potion of the fuel injection valve of the present invention.

As is best seen from FIG. 2, in a lower end of magnetic metal tube 3, more specifically, in a lower end of smaller diameter lower portion 3*b* of metal tube 3, there is tightly installed a cylindrical valve seat member 7. In the illustrated embodiment, cylindrical valve seat member 7 is secured to metal tube 3 by means of welding.

Valve seat member 7 has a generally conical bore with a valve seat 7*a* on which a valve ball 11 is operatively put. Valve seat member 7 has further at a lower end thereof a fuel injection aperture 7*b* from which the fuel is injected outward, that is, downward in the drawing. That is, when valve ball 11 is put on valve seat 7*a* as shown in the drawing, fuel injection valve 100 assumes its OFF or close position, while when valve ball 11 is lifted from valve seat 7*a*, fuel injection valve 100 assumes its ON or open position, as will become apparent as the description proceeds.

As best seen from FIG. 2, fuel injection aperture 7*b* of valve seat member 7 is covered with a circular nozzle plate 8 that is secured to a leading end surface of valve seat member 7 by means of welding. As shown, circular nozzle plate 8 generally comprises an annular base portion 8*a* that is secured to the leading end surface of valve seat member 7 and a domed center portion 8*b* that actually covers fuel injection aperture 7*b* of valve seat member 7. Domed center portion 8*b* is projected in a direction away from fuel injection aperture 7*b*.

Figure 3:
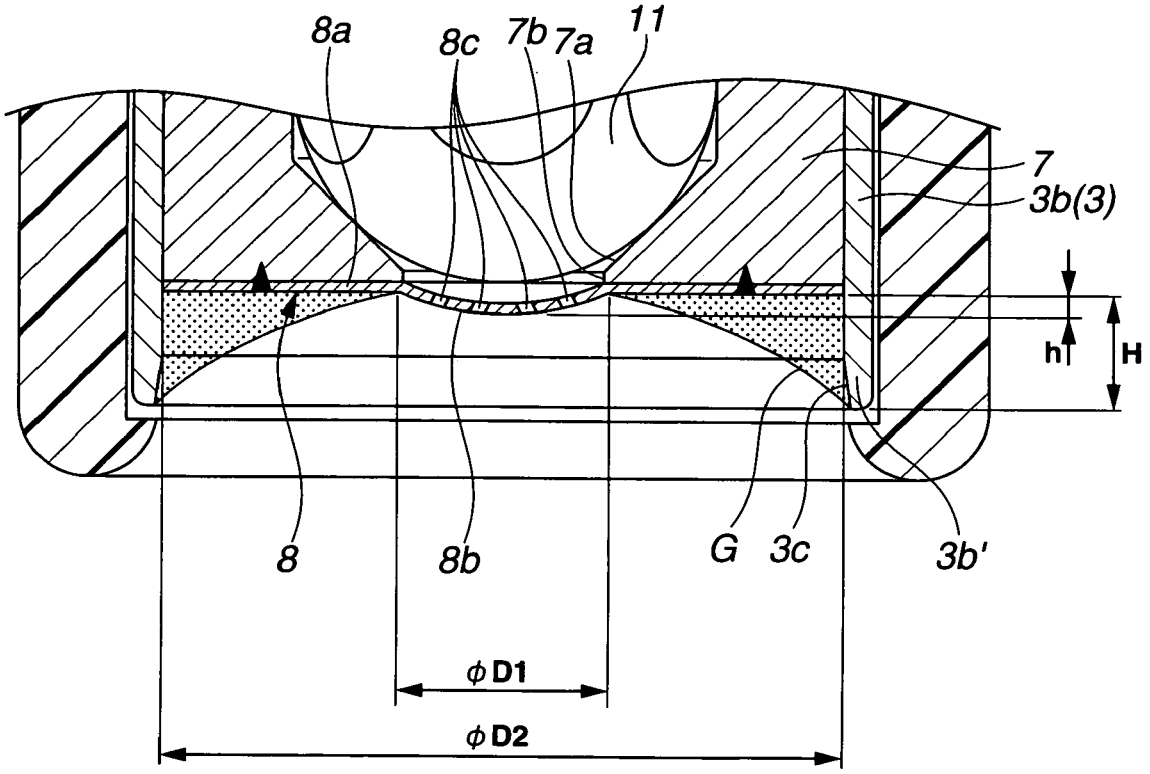
FIG. 3 is a much enlarged sectional view of a nozzle end portion of the fuel injection valve of the present invention.

As is seen from FIG. 3, domed center portion 8*b* is formed with a plurality of injection openings 8*c*. The detail of the circular nozzle plate 8 will be described hereinafter.

As is seen from FIGS. 2 and 3, between metal core tube 5 and valve seat member 7, there is arranged the above-mentioned valve body 9 that is axially movable in smaller diameter lower portion 3*b* of metal tube 3. As is mentioned hereinabove, valve body 9 is constructed of a magnetic metal material and comprises a larger diameter anchor upper portion 10*a* and a smaller diameter tubular lower portion 10*b*. Upper portion 10*a* of valve body 9 is formed with a cylindrical bore 10*c* into which a lower end of a coil spring 12 is received, and smaller diameter tubular lower portion 10*b* of valve body 9 has a leading end secured to valve ball 11 by means of welding.

As is seen from FIG. 1, coil spring 12 has an upper end seated on a lower end of a cylindrical adjuster member 19 received in metal core tube 5. Although not well shown in the drawing, adjuster member 19 has a threaded outer surface engaged with a threaded inner surface of metal core tube 5, so that turning adjuster member 19 about its axis can control or adjust the biasing force produced by coil spring 12. It is to be noted that due to the biasing force of coil spring 12, valve body 9 is biased to press valve ball 11 thereof against valve seat 7*a* of valve seat member 7, that is, in a direction to close fuel injection aperture 7*b*.

As is described hereinabove, around smaller diameter lower portion 3*b* of magnetic metal tube 3, there is arranged metal yoke member 13 which is cylindrical in shape. In the illustrated embodiment, a press fitting is used for securing yoke member 13 to smaller diameter lower portion 3*b* of magnetic metal tube 3.

As is seen from FIG. 1, between yoke member 13 and smaller diameter lower portion 3*b* of magnetic metal tube 3, there is arranged a connecting core 14 which is a generally C-shaped magnetic metal member put around the smaller diameter lower portion 3*b*.

Furthermore, between yoke member 13 and smaller diameter lower portion 3*b* of magnetic metal tube 3, there is concentrically arranged the above-mentioned electromagnetic coil 15. This coil 15 comprises a cylindrical plastic bobbin 15*a* concentrically disposed about smaller diameter lower portion 3*b* of metal tube 3 and a coil proper 15*b* wound on bobbin 15*a*. Electromagnetic coil 15 is connected to a power source (not shown) through wires 20*a* embedded in both plastic cover 16 and plastic casing 2 and pins 20*b* installed in a connector part 17. As shown, connector part 17 is integral with plastic casing 2.

As is understood from FIG. 1, plastic cover 16 is partially put on the outer surface of magnetic metal tube 3. It is to be noted that yoke member 13, connecting core 14 and electromagnetic coil 15 are integrally assembled when plastic cover 16, plastic casing 2 and connector part 17 are molded by means of injection molding.

In OFF condition wherein electromagnetic coil 15 is not energized, valve ball 11 of valve body 9 is pressed against valve seat 7*a* of valve seat member 7 due to the biasing force of coil spring 12. Thus, in this condition, fuel injection aperture 7*b* of fuel injection valve 100 is closed.

As is seen from FIG. 1, in the close condition of valve 100, there is defined the clearance "δ" between an upper end of anchor portion 10*a* of valve body 9 and a lower end of metal core tube 5.

While, when electromagnetic coil 15 is energized, metal core tube 5, anchor portion 10*a* and yoke member 13 constitute a closed magnetic circuit, and thus, to anchor portion 10*a*, there is applied a magnetic force in a direction to pull it 10*a* toward metal core tube 5. Since in this condition the magnetic force thus produced is larger than the biasing force produced by coil spring 12, valve body 9 is pulled toward core tube 5 separating valve ball 11 of valve body 9 from valve seat 7*a* of valve seat member 7. Thus, in this condition, fuel injection aperture 7*b* of fuel injection valve 100 is opened.

As will be understood from FIGS. 1 and 2, in the open condition of fuel injection valve 100, pressurized fuel in the interior 4 of magnetic metal tube 3 is forced to run through the center passage of adjuster member 19, cylindrical bore 10*c* of valve body 9, windows 9*a* formed in smaller diameter tubular lower portion 10*b* of valve body 9, a back pressure chamber 6 defined between smaller diameter lower portion 10*b* and magnetic metal tube 3 and a certain clearance defined between valve ball 11 and valve seat 7*a* and injected outward, that is, downward in the drawings, from fuel injection aperture 7*b* of valve seat member 7, more specifically, from fuel injection openings 8*c* (see FIG. 3) of circular nozzle plate 8 that covers fuel injection aperture 7*b*.

In the following, important features of the present invention will be described in detail with reference to the drawings, particularly FIG. 3.

As is well shown in FIG. 3 and is described hereinabove, circular nozzle plate 8 comprises an annular base portion 8*a* that is secured to the leading end surface of valve seat member 7, a domed center portion 8*b* that actually covers fuel injection aperture 7*b* of valve seat member 7 and a plurality of injection openings 8*c* that are formed in domed center portion 8*b*.

As is seen from FIG. 3, smaller diameter lower portion 3*b* of magnetic metal tube 3 has a lower end part 3*b*' that projects downward beyond circular nozzle plate 8 by a certain degree. With this, as is indicated by a shadowed zone, there is formed a so-called fuel holding recess "G" which is defined by a lower surface of annular base portion 8*a* of circular nozzle plate 8 and an inner surface 3*c* of lower end part 3*b*' of magnetic metal tube 3. That is, fuel holding recess "G" is constructed to hold a certain amount of fuel by the force of a surface tension possessed by the fuel.

It is to be noted that due to the projected shape of domed center portion 8*b*, fuel injection openings 8*c* formed in domed center portion 8*b* are prevented from being covered by the fuel contained in fuel holding recess "G". As is known, such domed center portion 8*b* can be easily produced by pressing a spherical had member against a metal plate.

As is seen from FIG. 3, the thickness of fuel contained in fuel holding recess "G" increases with increase of a distance from the annular periphery of domed center portion 8*b*. This means that fuel injection openings 8*c* are positioned away from the area where a larger amount of fuel is contained, which minimizes the possibility of covering fuel injection openings 8*c* with the residual fuel on circular nozzle plate 8. In other words, fuel injection openings 8*c* are suppressed from having the undesired fuel composition deposit.

In order to find out the optimum shape of fuel holding recess "G", that is, in order to minimize the possibility of covering fuel injection openings 8*c* with a residual fuel on circular nozzle plate 8, the inventor carried out various examinations and finally found the optimum shape, which is substantially defined by a diameter "D1" of domed center portion 8*b* of circular nozzle plate 8, an inner diameter "D2" of lower end part 3*b*' of magnetic metal tube 3, a height "h" of domed center portion 8*b* and a height "H" of lower end part 3*b*'. As is seen from FIG. 3, the height "H" is the length from a peripheral end of circular nozzle plate 8 to the leading end of lower end part 3*b*'.

The examinations carried out by the inventor will be described in the following.

Examination-1

Various samples of the fuel injection valve that are different in shape (viz., "D1" and "h") of domed center portion 8*b* of circular nozzle plate 8 were prepared and subjected to a fuel injection operation using an internal combustion engine.

According to this Examination, the inventor found that when domed center portion 8*b* of the fuel injection valve satisfies the following dimensional condition, fuel injection openings 8*c* of domed center portion 8*b* are suppressed from having the undesired fuel composition deposit.

That is:

$$1.5\text{ mm} \leqq D1 \leqq 2.5\text{ mm} \quad (1)$$

and $$0.1\text{ mm} \leqq h \quad (2)$$

Actually, when domed center portion 8*b* did not satisfy the above-mentioned dimensional condition (viz., (1) and (2)), some of the samples showed a certain fuel composition deposit on a peripheral area of fuel injection openings 8*c*.

In view of the above, the inventor has the following consideration for the dimensional condition of domed center portion 8*b* of circular nozzle plate 8 installed in the fuel injection valve.

If the diameter "D1" is too small, fuel holding recess "G" thus produced has a center portion thereof advanced largely to a center area of domed center portion 8*b*, which increases the possibility of covering some of fuel injection openings 8*c* of domed center portion 8*b* with a residual fuel. While, if the diameter "D1" is too large, the distance between the periphery of domed center portion 8*b* of circular nozzle plate 8 and the inner surface 3*c* of lower end part 3*b*' of magnetic metal tube 3 becomes very short, which reduces the bottom area of fuel holding recess "G" causing increase in height of the recess "G" and thus increasing the possibility of covering some of fuel injection openings 8*c* with the residual fuel. Furthermore, if the height "h" is too small, the possibility of covering some of fuel injection openings 8*c* with the residual fuel is increased.

Examination-2

Like the above, various samples of the fuel injection valve that are different in shape (viz., "D1" and "D2") of annular base portion 8*a* of circular nozzle plate 8 were prepared and subjected to a fuel injection operation using the internal combustion engine.

According to this Examination, the inventor found that when annular base potion 8*a* of the fuel injection valve satisfies the following dimensional condition, fuel injection openings 8*c* of domed center portion 8*b* are suppressed from having the undesired fuel composition deposit.

That is:

$$(D2-D1)/2 \geqq 1.25\text{ mm} \quad (3)$$

Actually, when annular base portion 8*a* did not satisfy the above-mentioned dimensional condition (viz., (3)), some of the samples showed a certain fuel composition deposit on a peripheral area of fuel injection openings 8*c*.

In view of the above, the inventor has the following consideration for the dimensional condition of annular base portion 8*a* of circular nozzle plate 8 installed in the fuel injection valve.

If the value "(D2−D1)/2" is too small, that is, if the distance between the periphery of domed center portion 8*b* of circular nozzle plate 8 and inner surface 3*c* of lower end part 3*b*' of magnetic metal tube 3 is too small, that is, smaller than 1.25 mm, the bottom area of fuel holding recess "G" is reduced which causes increase in height of the recess "G" and thus increases the possibility of covering some of fuel injection openings 8*c* with the residual fuel. The dimensional condition of (3) means that fuel holding recess "G" should be located near the lower end part 3*b*' of magnetic metal tube 3.

Examination-3

Like the above, various samples of the fuel injection valve that are different in size (viz., "H") of lower end part 3*b*' of magnetic metal tube 3 were prepared and subjected to a fuel injection operation using the internal combustion engine.

According to this Examination, the inventor found that when lower end part 3*b*' of the fuel injection valve satisfies the following dimensional condition, fuel injection openings 8*c* of domed center portion 8*b* are suppressed from having the undesired fuel composition deposit.

That is:

$$H \leqq 2.0\text{ mm} \quad (4)$$

Actually, when lower end part 3*b*' did not satisfy the above-mentioned dimensional condition (viz., (4)), some of the samples showed a certain fuel composition deposit on a peripheral area of fuel injection openings 8*c*.

In view of the above, the inventor has the following consideration for the dimensional condition of lower end part 3*b*' of magnetic metal tube 3 installed in the fuel injection valve.

If the height "H" is too large, a fuel trapping by lower end part 3*b*' becomes remarkable and thus an actual capacity of fuel holding recess "G" is increased, which increases the possibility of covering some of fuel injection openings 8*c* of domed center portion 8*b* with the residual fuel.

As a result of the above-mentioned three Examinations, the inventor noted that if the fuel injection valve satisfies all of the above-mentioned dimensional conditions, that is, (1), (2), (3) and (4), the valve would show the best performance in suppressing formation of undesired fuel composition deposit on the peripheral area of fuel injection openings 8*c*.

Figure 4:
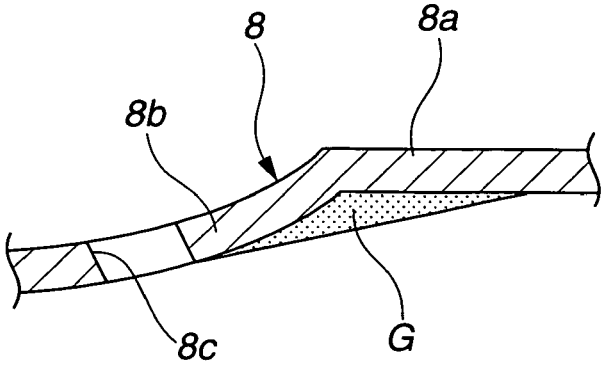
FIG. 4 is a much enlarged but partial view of a circular nozzle plate employed in the fuel injection valve of the present invention.

FIG. 4 shows an advantage expected by the present invention when a small volume of fuel holding recess "G" is produced at a bent border portion between domed center portion 8*b* and annular base portion 8*a*. As is understood from this drawing, in such case, an annular recess defined by the bent border portion can serve as a container for the fuel, and thus, fuel injection openings 8*c* of domed center portion 8*b* are suppressed from being covered with the fuel, which suppresses or at least minimizes the possibility of having the undesired fuel composition deposit on the peripheral area of fuel injection openings 8*c*.

As is described hereinabove, in the fuel injection valve of the present invention, a circular nozzle plate 8 having a domed center portion 8*b* around an annular base portion 8*a* is set in a fuel injection nozzle part of the valve, and a lower end part 3*b*' of a magnetic metal tube 3 is arranged to surround circular nozzle plate 8. With this, a so-called fuel holding recess "G" is produced which is defined by annular base portion 8*a* and lower end part 3*b*'. The fuel holding recess "G" holds a certain amount of fuel by the force of a surface tension possessed by the fuel. Fuel injection openings 8*c* formed in domed center portion 8*b* are constructed not to be covered with a fuel in fuel holding recess "G". In other words, fuel holding recess "G" is positioned near the lower end part 3*b*' of magnetic metal tube 3 that is away from fuel injection openings 8*c*. Accordingly, possibility of having undesired fuel composition deposit at the position of fuel injection openings 8*c* is suppressed or at least minimized.

If the fuel injection valve 100 satisfies the above-mentioned dimensional condition (1), (2), (3) or (4) in the above-mentioned manner, the valve 100 shows a satisfied performance in suppressing formation of the undesired fuel composition deposit.

Furthermore, if the fuel injection valve 100 satisfies all of the above-mentioned dimensional conditions (1), (2), (3) and (4), the valve 100 shows the best performance in suppressing formation of the undesired fuel composition deposit.

Furthermore, due to the inherent construction of the circular nozzle plate 8 with the domed center portion 8*b*, there is formed an annular recess around the domed center portion 8*b*, which can serve as a container for a small amount of residual fuel. This suppresses or at least minimizes the possibility of having undesired fuel composition deposit on the peripheral area of fuel injection openings 8*c*.

If desired, the following modifications may be used in the present invention.

In the above-mentioned embodiment 100, the lower end part 3*b*' is a part of the magnetic metal tube 3. However, if desired, a separate tube member may be used in place of such lower end part 3*b*'.

Furthermore, if desired, circular nozzle plate 8 may be formed on its lower surface with a plurality of radially extending grooves, each extending between the peripheral portion of domed center portion 8*b* and inner surface 3*c* of lower end part 3*b*'. Furthermore, the lower surface of circular nozzle plate 8 may be formed with a plurality of projections and recesses. With these measures, fuel containing capacity of fuel holding recess "G" is increased.

The entire contents of Japanese Patent Application 2005-056588 filed Mar. 1, 2005 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A fuel injection valve comprising:

a valve seat member having a valve seat with a fuel injection aperture;

a valve body that is movable between a close position wherein the valve body is put on the valve seat and an open position wherein the valve body is separated from the valve seat;

a biasing member that biases the valve body in a direction of the close position;

an electromagnetic coil that, upon energization, moves the valve body in a direction of the open position against the biasing force of the biasing member;

a nozzle plate connected to the valve seat member in a manner to cover the fuel injection aperture, the nozzle plate having at a part thereof facing the fuel injection aperture a domed portion that is projected away from the fuel injection aperture, the domed portion having a plurality of fuel injection openings; and a side wall that extends around and along a periphery of the nozzle plate so as to form a fuel holding recess that is defined by the nozzle plate other than domed portion and the side wall, the fuel holding recess being able to hold a certain amount of a fuel by the force of a surface tension possessed by the fuel, wherein the nozzle plate is circular in shape and the side wall is cylindrical in shape, and in which the valve seat member is cylindrical in shape, and in which the cylindrical side wall is a lower end part of a magnetic metal tube that surrounds the cylindrical valve seat member.

2. A fuel injection valve as claimed in claim 1 in which the domed portion of the nozzle plate is projected into an enclosed space defined by the nozzle plate and the side wall.

3. A fuel injection valve as claimed in claim 1, in which the magnetic metal tube constitutes a constructional base hollow member through which a fuel flows.

4. A fuel injection valve comprising:

a valve seat member having a valve seat with a fuel injection aperture;

a valve body that is movable between a close position wherein the valve body is put on the valve seat and an open position wherein the valve body is separated from the valve seat;

a biasing member that biases the valve body in a direction of the close position;

an electromagnetic coil that, upon energization, moves the valve body in a direction of the open position against the biasing force of the biasing member;

a nozzle plate connected to the valve seat member in a manner to cover the fuel injection aperture, the nozzle plate having at a part thereof facing the fuel injection aperture a domed portion that is projected away from the fuel injection aperture, the domed portion having a plurality of fuel injection openings; and a side wall that extends around and along a periphery of the nozzle plate so as to form a fuel holding recess that is defined by the nozzle plate other than domed portion and the side wall, the fuel holding recess being able to hold a certain amount of a fuel by the force of a surface tension possessed by the fuel, wherein the domed portion of the nozzle plate is projected into an enclosed space defined by the nozzle plate and the side wall, and in which the following inequalities are established in a dimensional condition:

$$1.5\ \text{mm} \leqq D1 \leqq 2.5\ \text{mm} \quad (1)$$

and $$0.1\ \text{mm} \leqq h \quad (2)$$

wherein:

D1: diameter of the domed portion, h: height of the domed portion.

5. A fuel injection valve as claimed in claim 4, in which the nozzle plate is circular in shape and the side wall is cylindrical in shape.

6. A fuel injection valve as claimed in claim 4, in which the following inequality is established in a dimensional condition:

$$(D2-D1)/2 \geqq 1.25\ \text{mm} \quad (3)$$

wherein:

D2: inner diameter of the cylindrical side wall.

7. A fuel injection valve as claimed in claim 6, in which the following inequality is established in a dimensional condition:

$$H \leqq 2.0\ \text{mm} \quad (4)$$

wherein:

H: height of the cylindrical side wall.

* * * * *